US011918872B2

(12) United States Patent
Geller et al.

(10) Patent No.: US 11,918,872 B2
(45) Date of Patent: Mar. 5, 2024

(54) GOLF BALL TEEING DEVICE AND STAND THEREFOR

(71) Applicant: Tee Tender LLC, Mount Kisco, NY (US)

(72) Inventors: Stanley Geller, Northvale, NJ (US); Robert Pascale, Matthews, NC (US)

(73) Assignee: Tee Tender LLC, Mount Kisco, NY (US)

( * ) Notice: Subject to any disclaimer, the term of this patent is extended or adjusted under 35 U.S.C. 154(b) by 0 days.

(21) Appl. No.: 18/116,027

(22) Filed: Mar. 1, 2023

(65) Prior Publication Data

US 2023/0293960 A1 Sep. 21, 2023

Related U.S. Application Data

(60) Provisional application No. 63/423,859, filed on Nov. 9, 2022, provisional application No. 63/320,781, filed on Mar. 17, 2022.

(51) Int. Cl.
*A63B 57/00* (2015.01)

(52) U.S. Cl.
CPC ..... *A63B 57/0037* (2013.01)

(58) Field of Classification Search
CPC .... A63B 57/0037; A63B 55/10; A01K 97/10; F16M 11/242; F16M 11/046
See application file for complete search history.

(56) References Cited

U.S. PATENT DOCUMENTS 2,609,198 A 9/1952 Armstrong
4,226,389 A * 10/1980 Neth ..... A63B 55/57 248/166
4,526,369 A * 7/1985 Phelps ..... A63B 47/02 473/133
4,609,174 A * 9/1986 Nakatani ..... F16M 11/046 248/168
4,616,826 A * 10/1986 Trefts ..... A63B 57/0037 473/133
4,951,947 A 8/1990 Kopfle
5,080,357 A * 1/1992 Wolf ..... A63B 57/0037 473/133
5,308,029 A * 5/1994 Bingham ..... F16M 11/041 52/632
5,310,177 A 5/1994 Conrad et al.
5,335,953 A * 8/1994 Luther, Sr. ..... A63B 47/02 294/99.1
5,482,247 A * 1/1996 Smith ..... A63B 69/3685 473/282
5,499,813 A 3/1996 Black
5,503,394 A * 4/1996 Mauck ..... A63B 55/10 473/282
5,669,646 A * 9/1997 Fiocca ..... A63B 57/203 294/19.2

(Continued)

FOREIGN PATENT DOCUMENTS

JP 4293804 A 7/2009
WO WO-2006043282 A1 * 4/2006 ..... F16M 11/02

(Continued)

*Primary Examiner* — Steven B Wong
(74) *Attorney, Agent, or Firm* — Dilworth & Barrese, LLP

(57) ABSTRACT

A golf ball teeing device allows a tee with a golf ball balanced thereon, to be securely pierced into the ground, without having to bend over.

11 Claims, 16 Drawing Sheets

(56) References Cited

U.S. PATENT DOCUMENTS

| | | | | |
|---|---|---|---|---|
| 5,672,121 | A * | 9/1997 | Miller | A63B 57/0037 294/19.2 |
| 5,707,303 | A * | 1/1998 | Berkowitz | A63B 57/0037 294/19.2 |
| 5,759,117 | A | 6/1998 | Erickson, Jr. | |
| 6,338,685 | B1 * | 1/2002 | Posluszny | A63B 57/0037 473/386 |
| 6,461,254 | B1 * | 10/2002 | Ballett | A63B 57/0006 473/386 |
| 6,716,118 | B1 * | 4/2004 | Asta | A63B 57/50 473/286 |
| 6,878,071 | B1 | 4/2005 | Schwieger et al. | |
| 6,887,169 | B2 | 5/2005 | Whitehill et al. | |
| 7,351,156 | B1 | 4/2008 | Panneri et al. | |
| 7,963,854 | B2 * | 6/2011 | Nugent | A63B 55/20 473/137 |
| 8,529,379 | B1 * | 9/2013 | Faircloth | A63B 57/0037 294/19.2 |
| 8,870,686 | B1 | 10/2014 | Johnson | |
| 9,950,227 | B1 * | 4/2018 | Faircloth | A63B 57/0037 |
| 10,238,936 | B2 | 3/2019 | Jensen | |
| D903,024 | S | 11/2020 | Mickley | |
| 11,118,726 | B2 * | 9/2021 | Gribble | F16M 11/242 |
| 11,179,612 | B2 * | 11/2021 | Nappe | A63B 57/353 |
| 2003/0102414 | A1 * | 6/2003 | Smart | A01K 97/10 248/163.1 |
| 2003/0203772 | A1 | 10/2003 | Paine | |
| 2003/0234326 | A1 * | 12/2003 | Crain | F16M 11/28 248/176.1 |
| 2004/0029653 | A1 * | 2/2004 | Whitehill | A63B 57/0037 473/386 |
| 2005/0170904 | A1 | 8/2005 | Smeeth | |
| 2006/0014596 | A1 | 1/2006 | Marcus et al. | |
| 2007/0184918 | A1 | 8/2007 | Ritch, Jr. | |
| 2007/0219014 | A1 | 9/2007 | Merriman | |
| 2007/0293353 | A1 | 12/2007 | Irwin | |

FOREIGN PATENT DOCUMENTS

| | | | |
|---|---|---|---|
| WO | 2014/170906 | A1 | 10/2014 |
| WO | 2022/029726 | A1 | 2/2022 |

* cited by examiner

GOLF BALL TEEING DEVICE AND STAND THEREFOR

BACKGROUND OF THE INVENTION

The present invention is directed to a golf ball teeing device which allows a golf ball to be placed on a tee and then implanted in the ground, without the golfer having to bend over. More particularly, the present invention is directed to such teeing device which reliably secures such a golf ball and tee on the ground, requiring a minimum of mechanical components which reliably perform with minimal amount of maintenance required or danger of breaking.

Golf ball teeing devices are known to provide for inserting a tee in the ground with a golf ball placed thereon. For example, WO 2022/029726 discloses such a golf aid device including a first spring interconnecting jaws for holding the golf ball and tee, and biasing such jaws closed. The jaws are interconnected by a taut cable interconnecting the jaws to a button at a remote end of the device. Depressing this button slackens the cable, allowing a second spring to bias the jaws into open position, and release the golf ball and tee from grip of the jaws.

U.S. Pat. Pub. No. 2004/0029633 is also directed to a golf ball and tee setter having a spring laterally biasing jaws of a ball cage closed, with downward pressure from a push rod at a remote end forcing the jaws open against the action of the spring. However, such devices require a large number of springs often biasing in opposition to one another. Such springs have finite operational life and can be easily deformed and bent out of shape.

Accordingly, it is an object of the present invention to improve reliably of mounting a golf ball and tee on the ground, especially from a standing position.

It is also an object of the present invention to provide for such mounting of a golf ball and tee with a device requiring a minimal number of components that can be easily serviced and not prone to breakage.

It is another object of the present invention to allow such golf ball teeing device to be securely mounted on the ground in upright position, when not in use.

SUMMARY OF THE INVENTION

These and other objects are provided by present invention, which is directed to a golf ball teeing device which allows a tee with a golf ball balanced thereon, to be securely pierced into the ground, without having to bend over.

The jaws of the device are biased closed, with a golf ball first positioned therebetween, and then a tee slid on top of the golf ball while the device is inverted. Then, the device is inverted and the tee pierced into the ground. A button on an opposite end of the device is then depressed to bias the jaws apart against action of biasing means and release both the tee and golf ball situated thereon.

More particularly, the golf ball teeing device has a seat for a golf ball, a pair of jaws arranged on either side of the golf ball seat and forming an opening for a tee for the golf ball at mating ends thereof, means for biasing the jaws together, a rod arranged to open the jaws against the biasing and release the golf ball and tee from therebetween, a tubular shaft on which the jaws are pivotally mounted, and through which the rod movably extends along the shaft, the rod being configured, when pushed, to contact the jaws and pivotally open them against said biasing means, a meshing gear situated at an end of the rod, and a pair of meshing gears each pivotally arranged on a respective jaw and interlocking with the meshing gear at the end of the rod. Pushing the rod against the action of the biasing means pivots the jaws outwardly from one another.

This arrangement facilitates mounting of a golf ball and tee during golfing, with minimal effort, and avoiding components prone to failure or distortion. A stand for securely mounting the teeing device in upright position is also provided.

BRIEF DESCRIPTION OF THE DRAWINGS

The features of the present invention will be described in greater detail with reference to the accompanying drawings, wherein.

DESCRIPTION OF THE PREFERRED EMBODIMENTS

Figure 1:
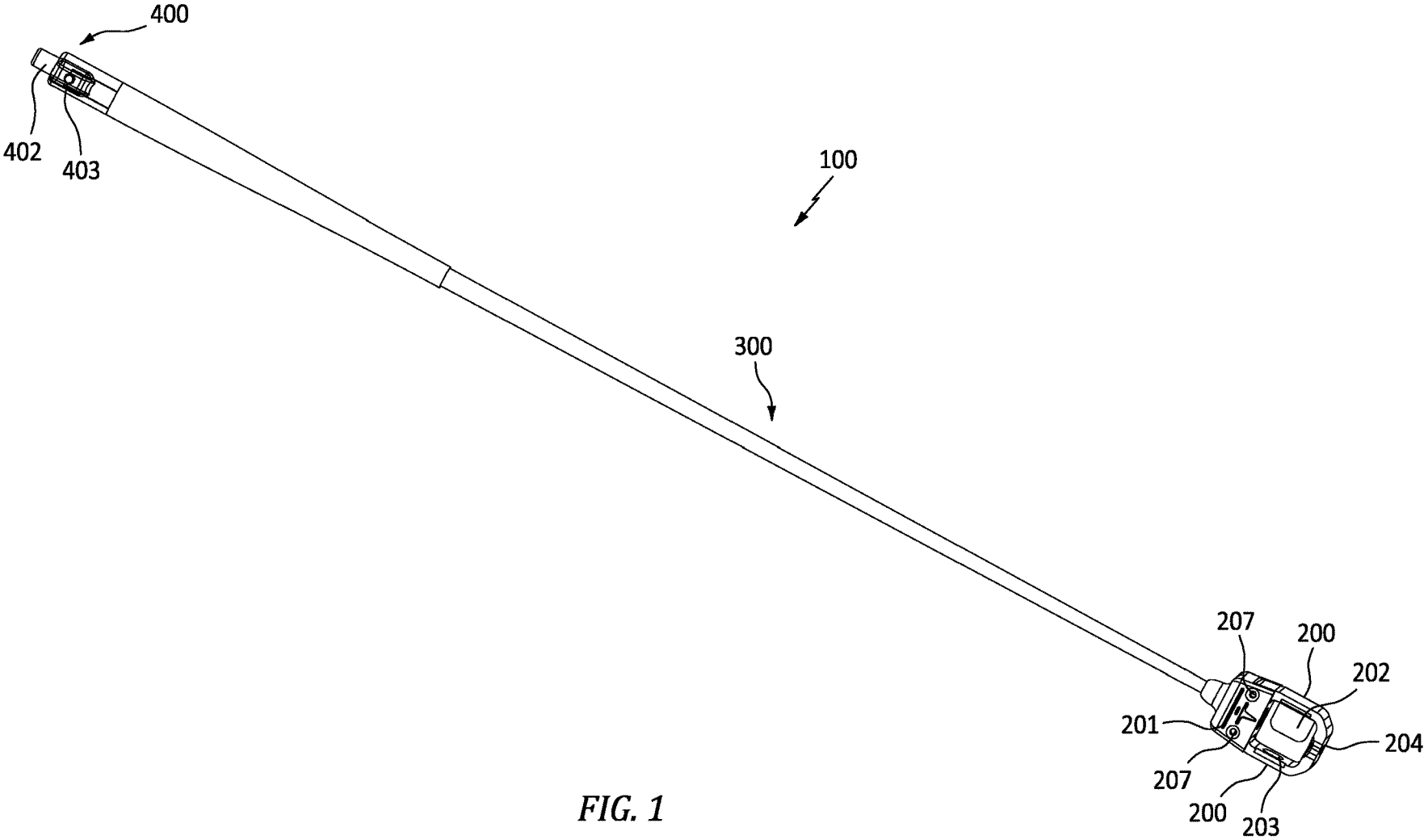
FIG. 1 is a perspective view of an embodiment of the golf ball teeing device.
Figure 2:
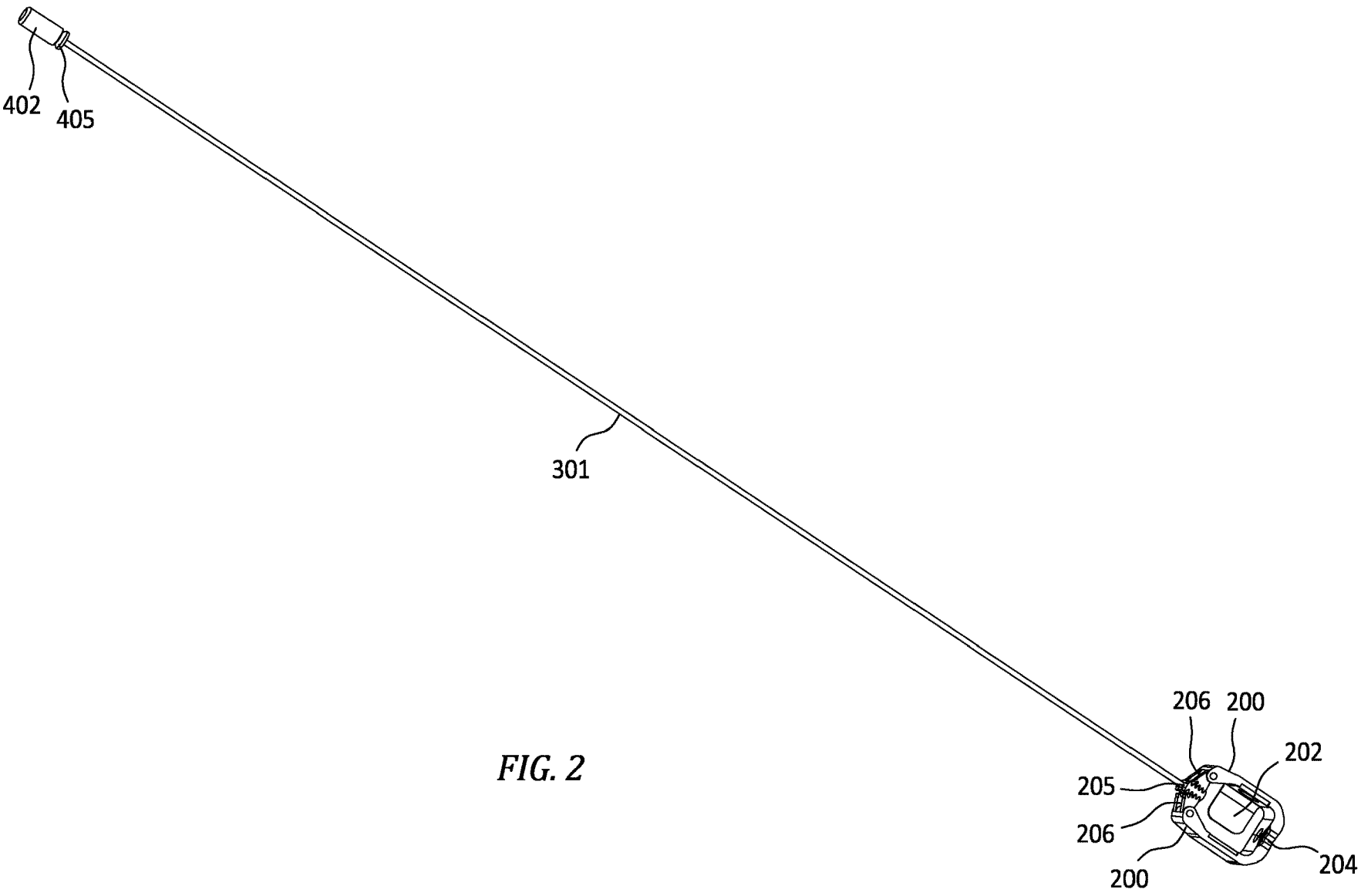
FIG. 2 is a perspective view of the interior mechanisms of FIG. 1.
Figure 3:
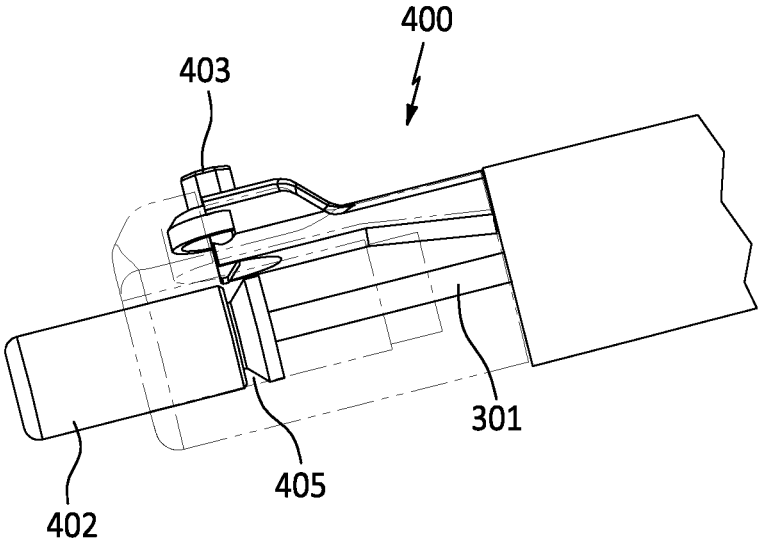
FIG. 3 is a partially transparent perspective view of the top part of the golf ball teeing device.
Figure 4:
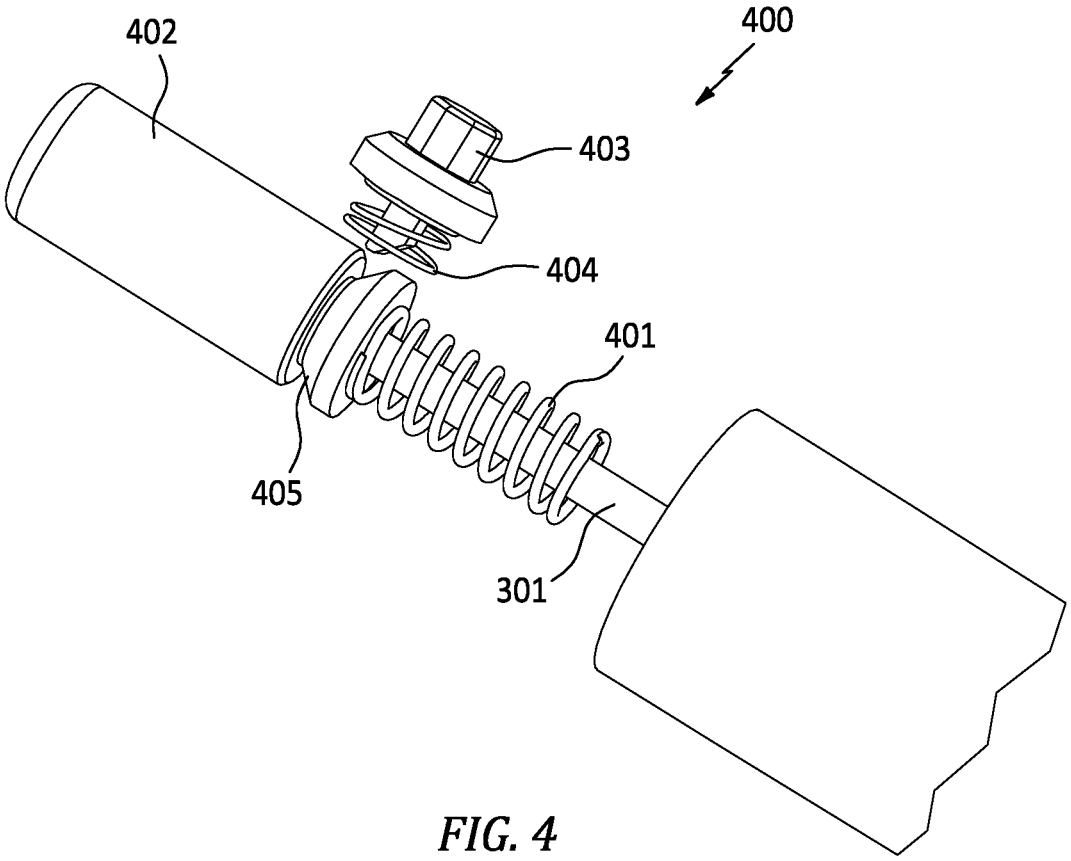
FIG. 4 is a perspective view of the interior mechanism in top part shown in FIG. 3.
Figure 5:
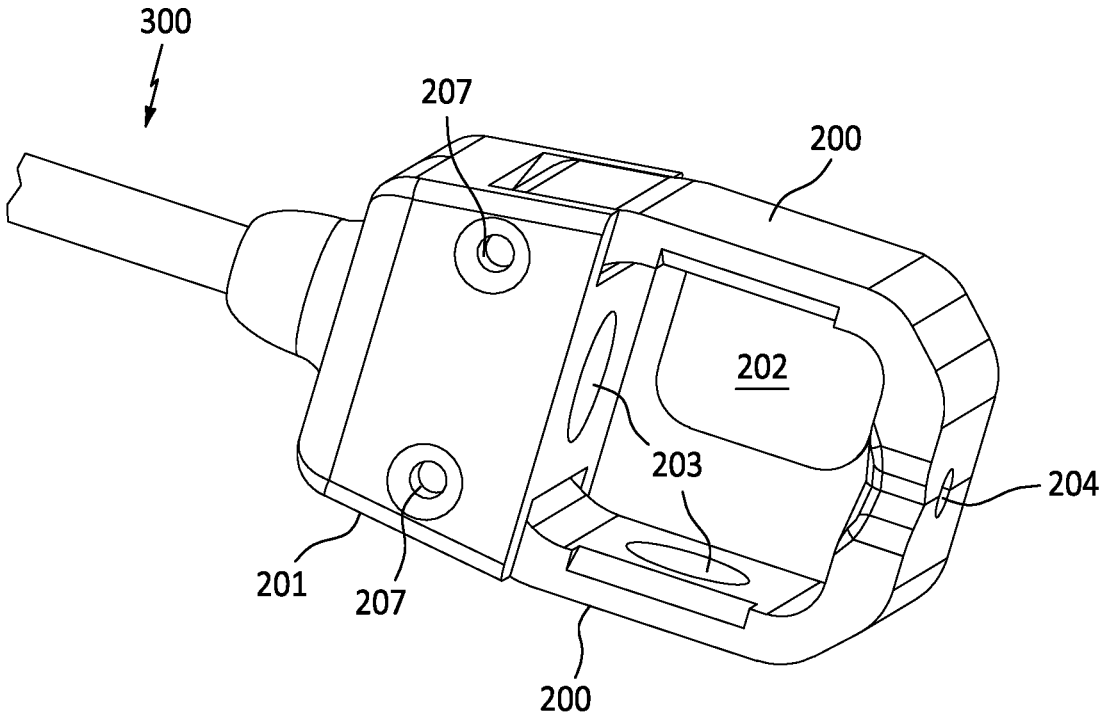
FIG. 5 is a side view of the bottom part of the golf ball teeing device.
Figure 6:
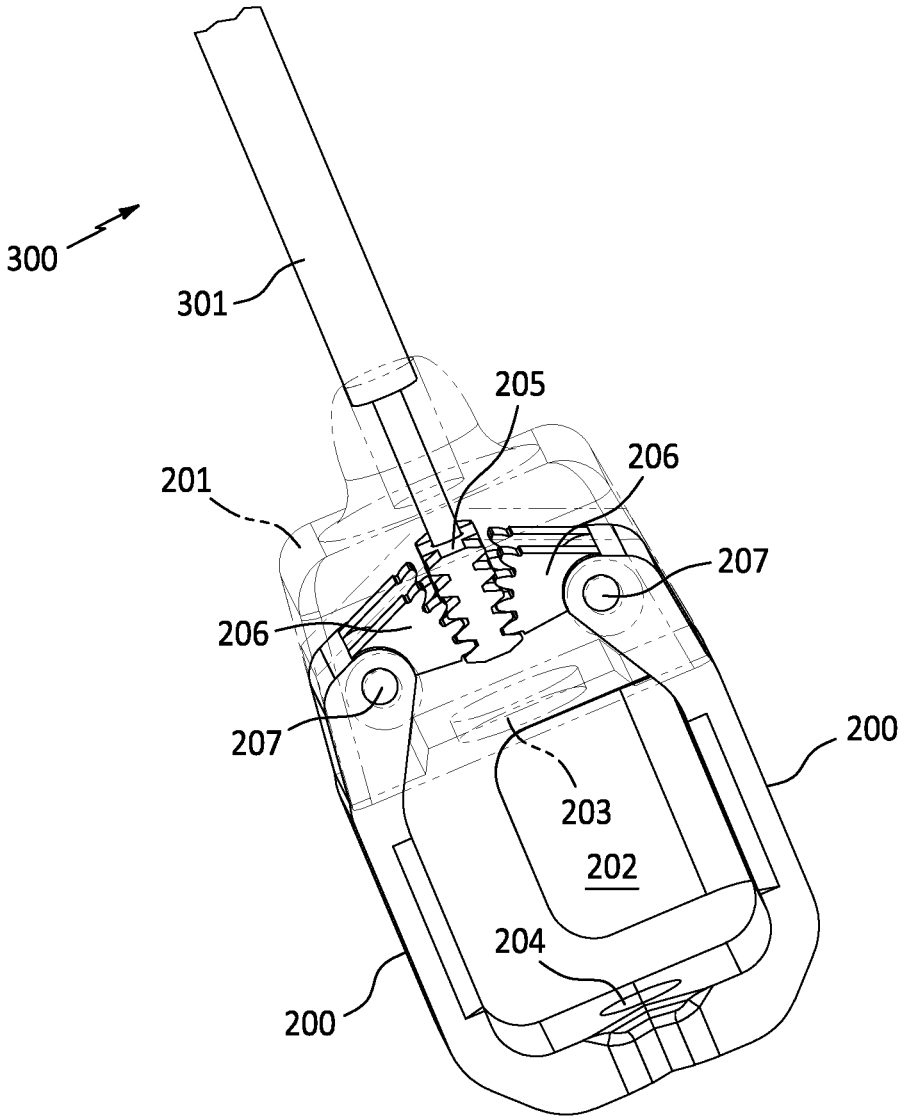
FIG. 6 is a partially transparent side view of the bottom part shown in FIG. 5.
Figure 7:
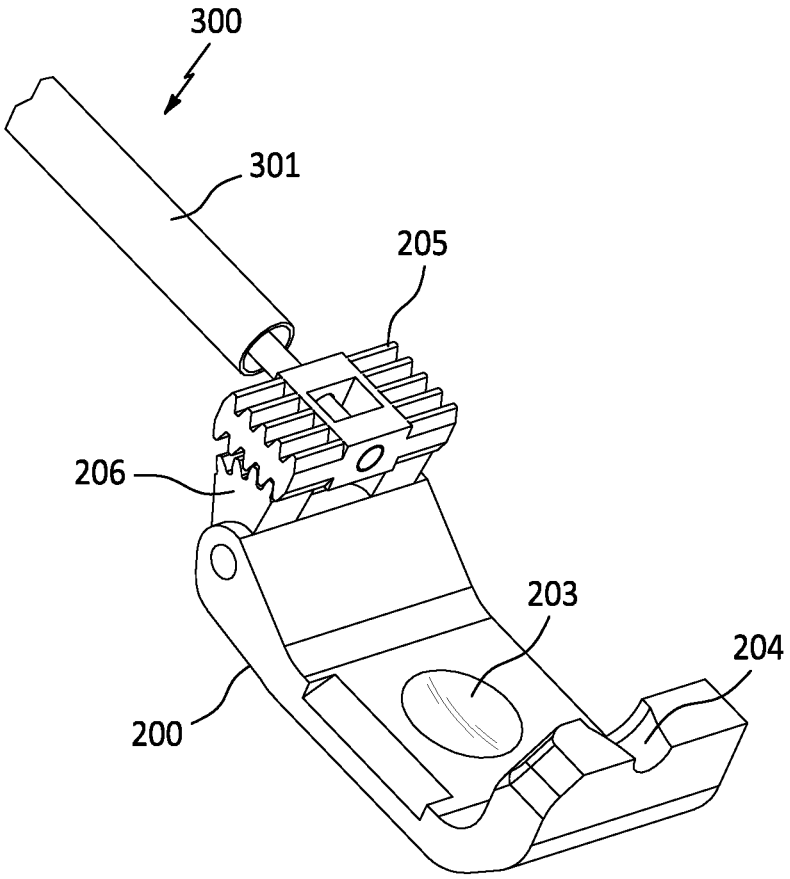
FIG. 7 is a perspective view of a portion of the internal mechanism of the bottom part of the golf ball teeing device of FIG. 6.
Figure 8:
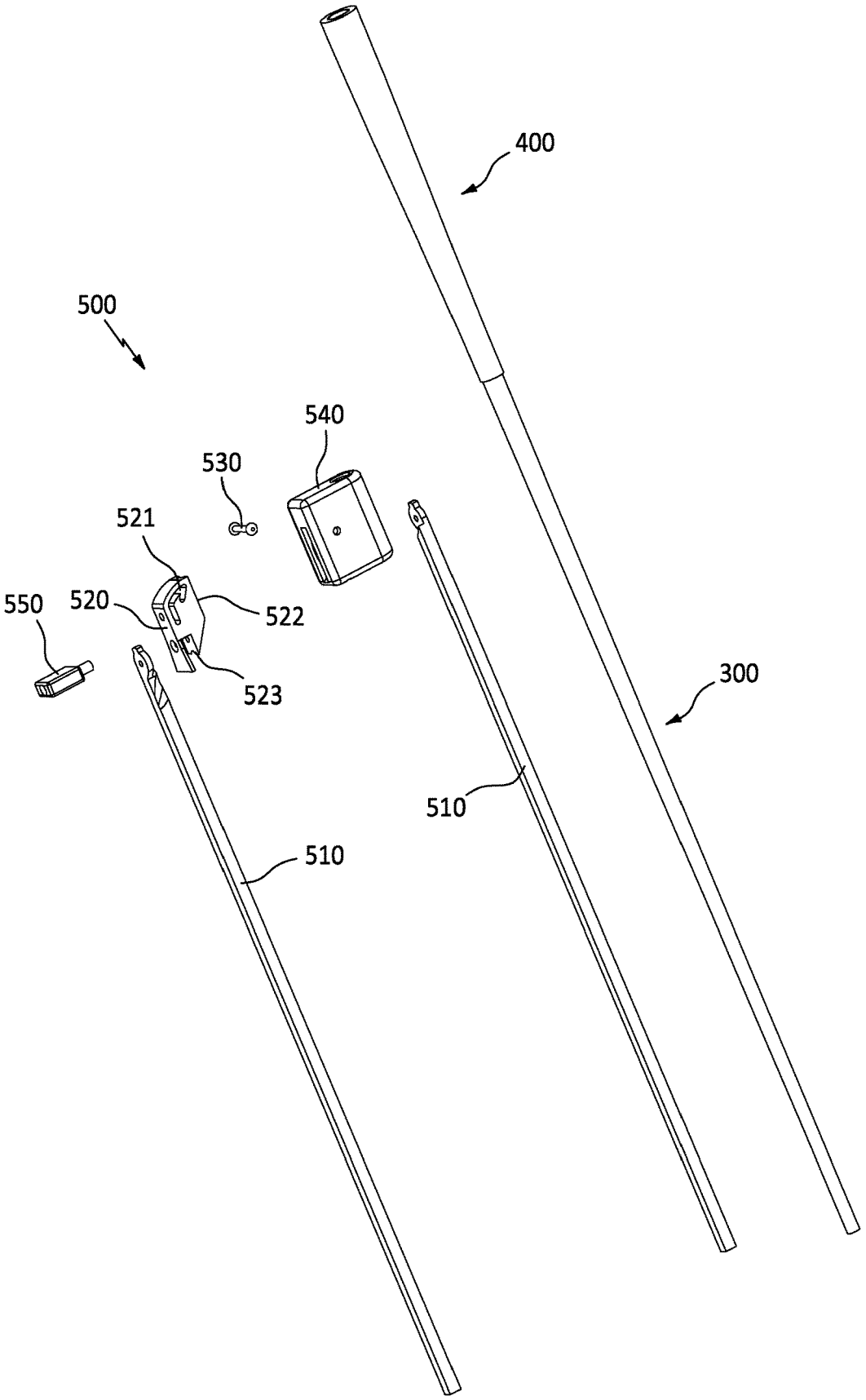
FIG. 8 is an exploded view showing the individual components forming a stand for the golf ball teeing device.
Figure 9:
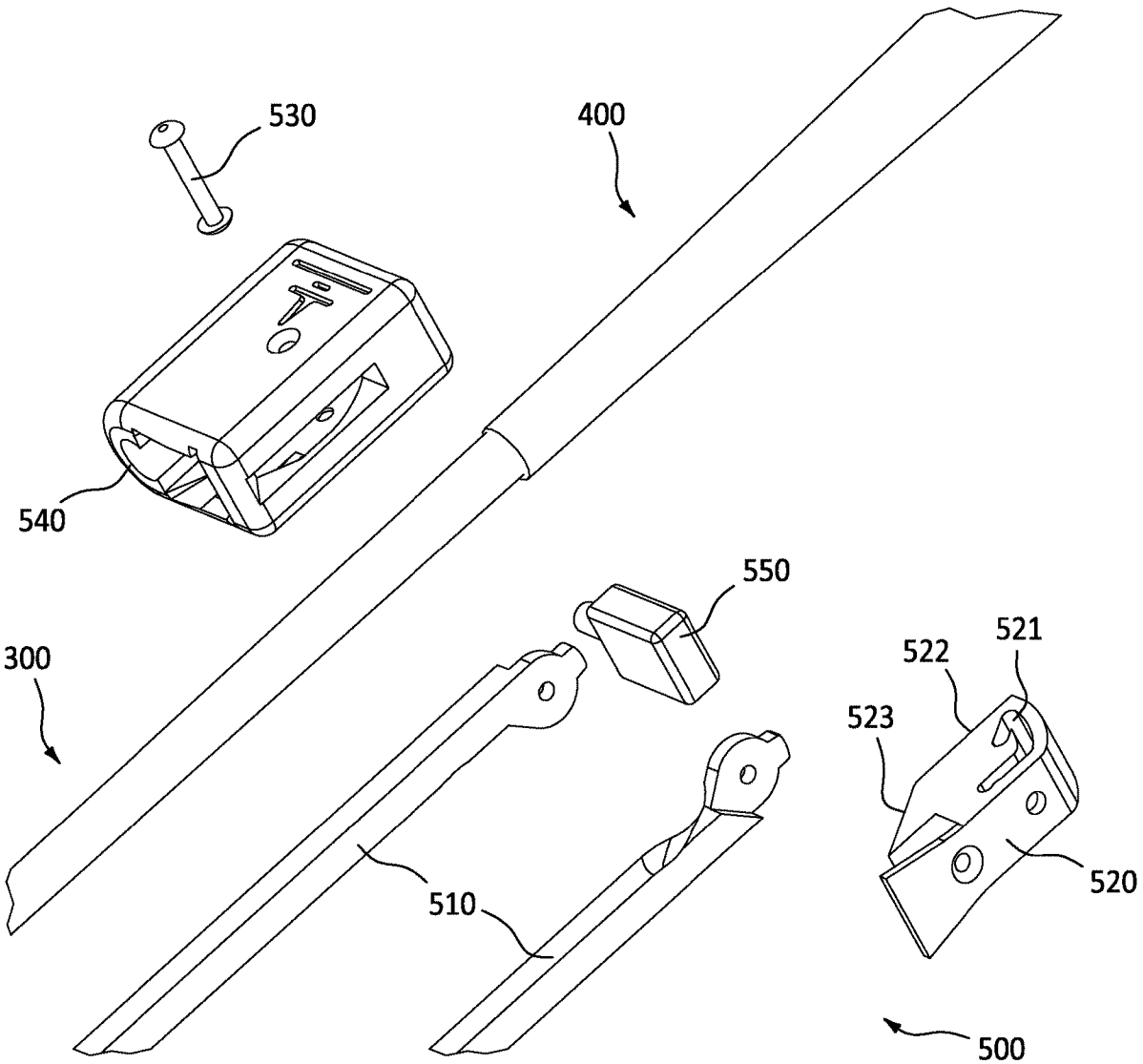
FIG. 9 is an enlarged partial plan view showing the certain of the individual components of FIG. 8.
Figure 10:
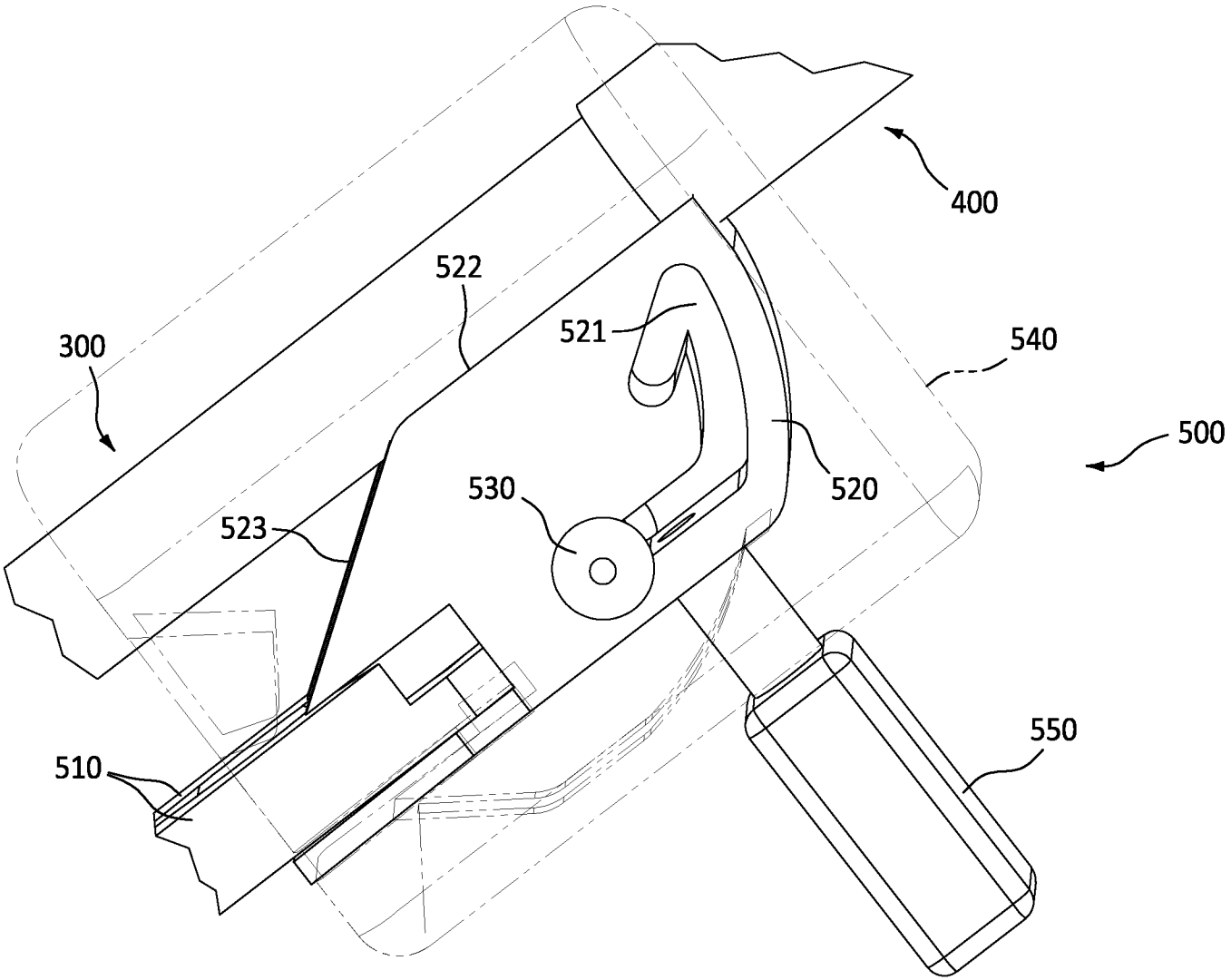
FIG. 10 is an enlarged, partially transparent, perspective view of the top of the stand of FIGS. 8 and 9.
Figure 11:
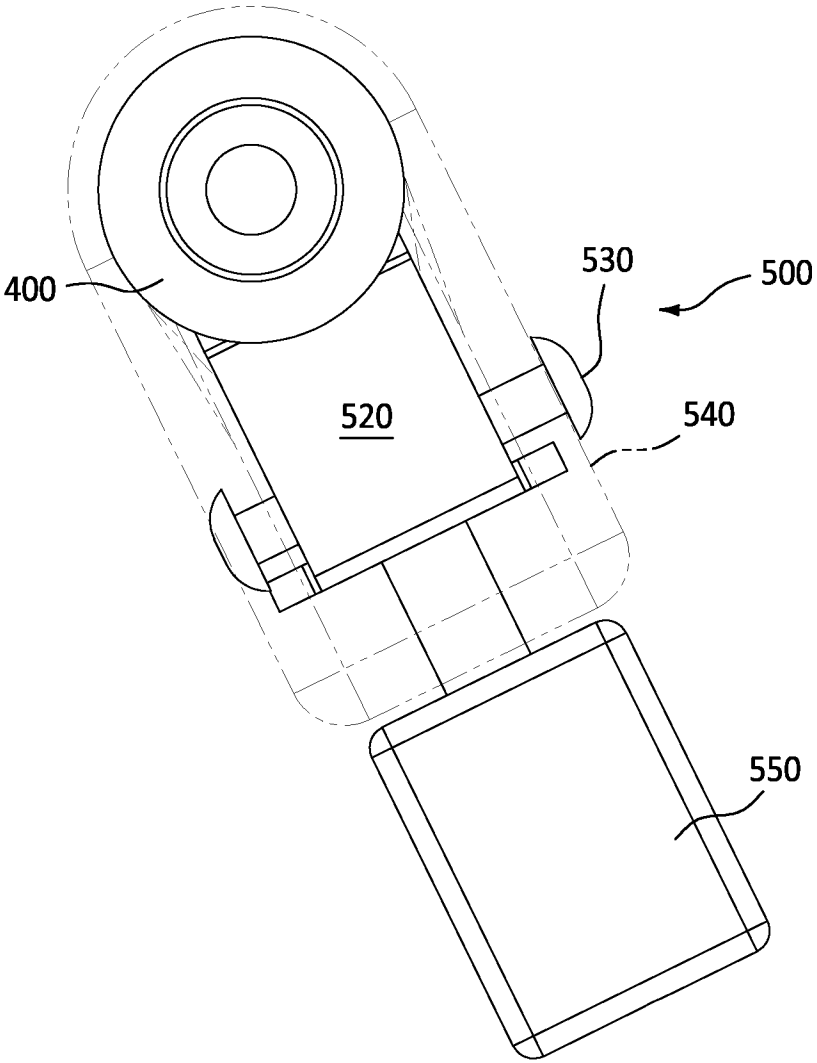
FIG. 11 is a top plan view of the teeing device and stand of FIG. 9, showing the triggering mechanism, FIG. 12 schematically illustrates the stand and golf ball teeing device extended in upright position to support the teeing device, FIG. 13 schematically illustrates the stand and golf ball teeing device retracted together for transport, FIG. 14 schematically illustrates piercing the tee into the ground with the golf ball positioned on top thereof, by the golf ball teeing device, FIG. 15 schematically illustrates lifting the golf ball teeing device away from the mounted golf ball and tee shown in FIG. 14, FIG. 16 schematically illustrates another embodiment of the stand supporting the golf ball teeing device in upright position.

As shown in the figures, the golf ball teeing device 100 has a pair of jaws 200 located at the bottom end and which are connected by a rod 301 to a releasing mechanism 400 at the top of the device 100. A golf ball is first loaded into a closed position of the jaws 200 of the device 100, onto an end of a collar 201 having a receptacle or curved indentation 203 for the ball. One jaw 200 has an L-shaped protrusion 202 to help guide and seat the golf ball during loading and each jaw 200, as well as the collar 201, has a respective curved indentation 203 to effectively seat the golf ball when inserted between the jaws 200 with the tee.

The tee is then loaded on top of the golf ball in the inverted position, by pressing the jaws 200 apart against biasing of the spring 401 at the top end of the gripping handle, and slipped in between the tips of the jaws 200 within the tee opening 204, which then snaps back upon release.

Figure 14:
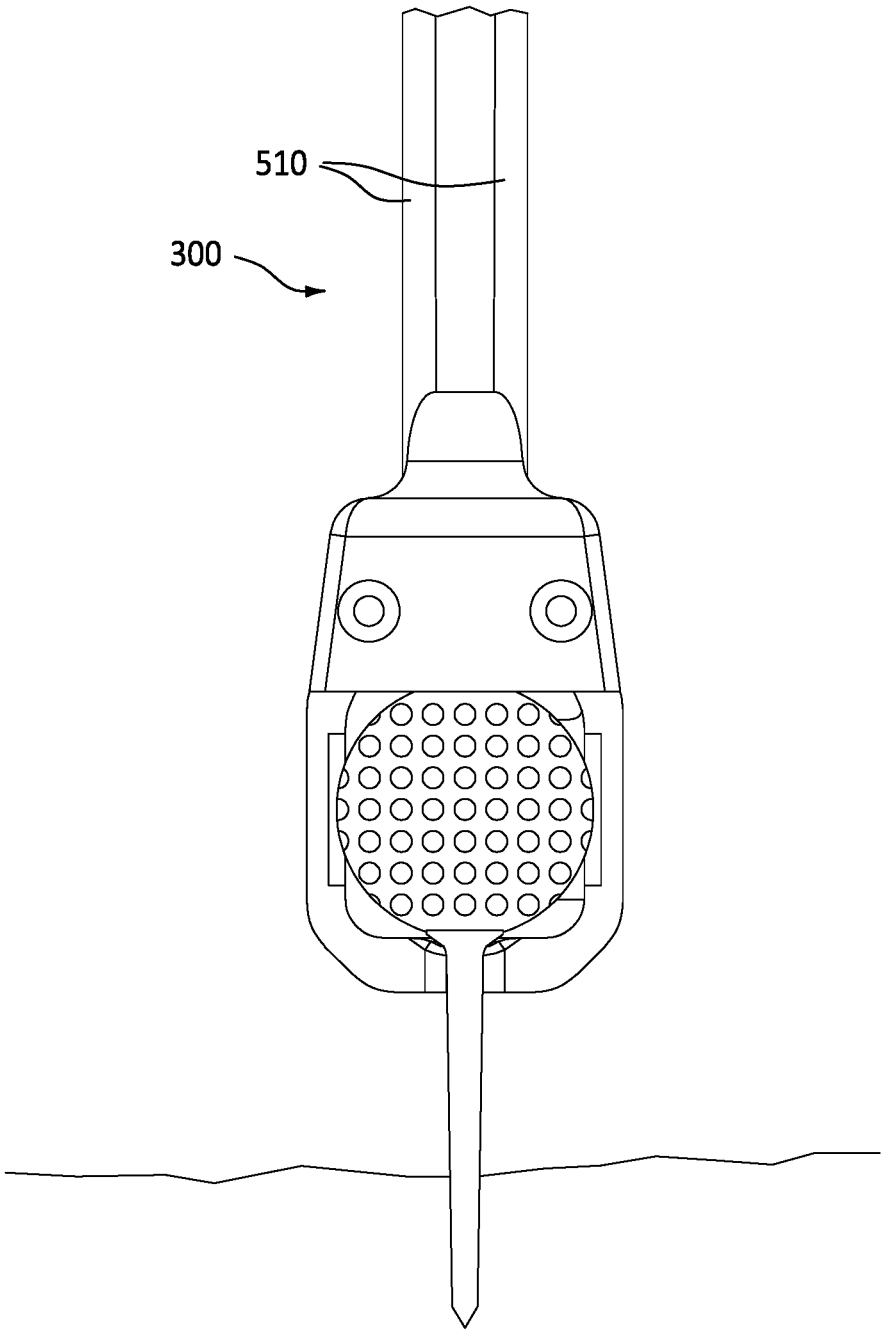
Figure 15:
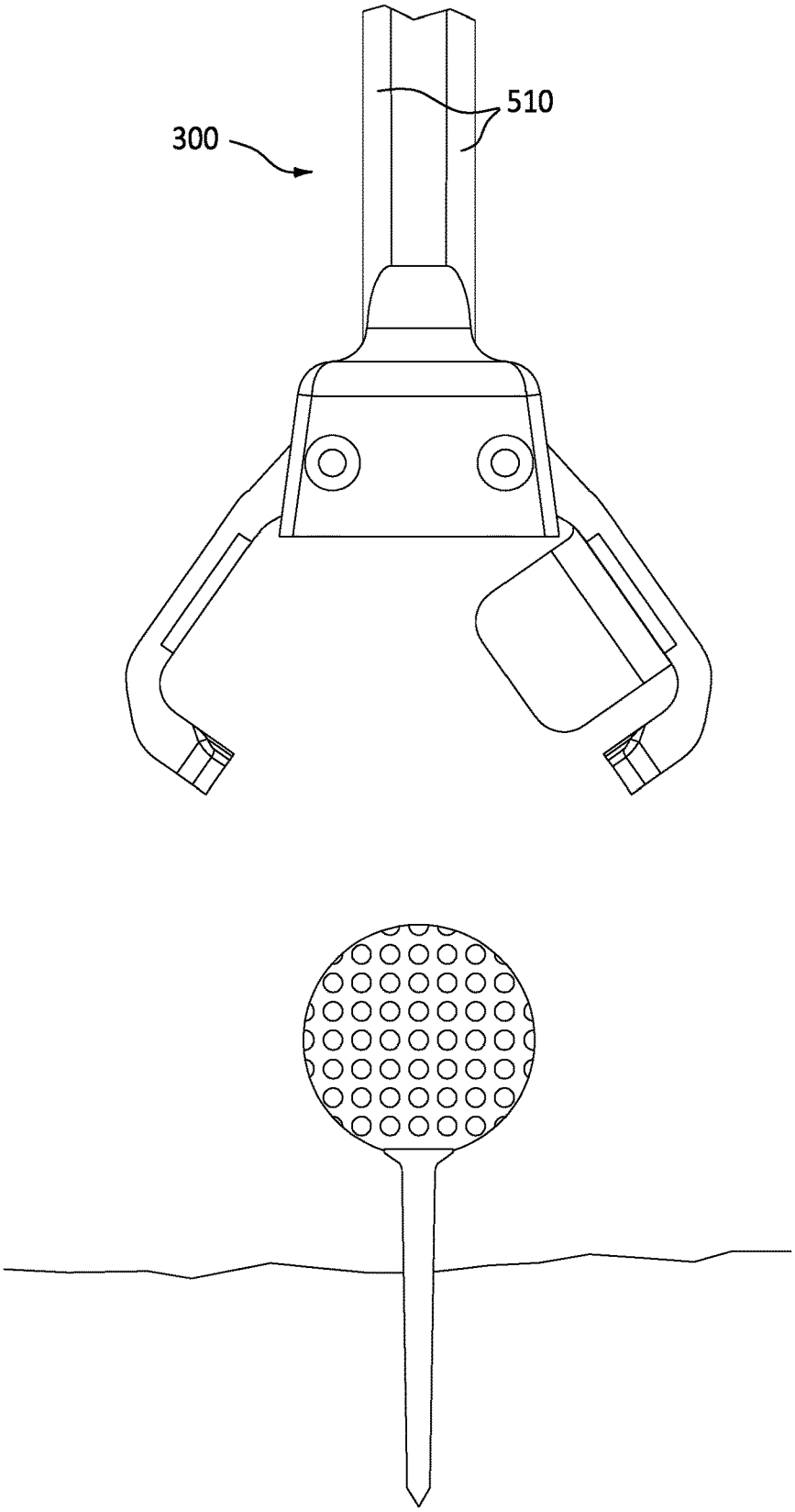

The device 100 is then inverted, as the tee is appropriately pierced into the ground (FIG. 14), i.e., at the teeing off location, driving range, etc. The button 402 within the releasing mechanism 400 is then pressed and opens the jaws 200 to release the golf ball and tee from the device 100 (FIG. 15). Depressing the button 402 pushes the rod 301 situated within the tubular shaft 300 downwardly, and which then moves an opposite end of the rod 301 which is attached to a gear rack 205, thus translating the lateral motion of the rod 301 to a rotational motion of the pinion gears 206 attached by pivot pins 207 to the jaws 200, to open the jaws 200. The pivot pins 207 pass through a collar 201 mounted on the end of the tubular shaft 300, and attach the jaws 200 to the pinion gears 206. The collar 201 securely holds the jaws 200 and pinion gears 206 in place relative to the gear rack 205. Other attachment means of the jaws 200 to the pinion gears 206 are contemplated.

When the button 402 is then released as the teeing device is lifted up and away from the golf ball and tee pierced into the ground (FIG. 15), the jaws 200 return to closed position by the action of the biasing compression spring 401 located within the releasing mechanism 400, extending around the internal rod 301, and coupled to the actuating button 402. The releasing mechanism 400 is formed as a handle similar to a golf club gripping end, with another locking button 403 integrated into the releasing mechanism 400 and which can be used to lock the actuating button 402 in the closed position of the jaws 200 by inserting into a groove 405 of the button 402. The locking button 403 is held against tension of a locking spring 404 and can be easily released to allow the device to be actuated by depressing the actuating button 402. This locking can ensure the device 100 remains closed during transport as well as keeping the jaws 200 closed during use. The locking button is arranged to engage and lock the actuating button from triggering, from only the side of the actuating button on which the locking button is mounted.

The present invention also facilitates picking up the tee and golf ball. For example, the button 402 can be depressed to move the jaws 200 apart against the action of the spring 401, and placed over the tee or golf ball. Then, releasing the button 402 will allow the jaws 200 to close around the golf ball or tee and, with the locking button 403 engaged to ensure jaws 200 remained closed, the golf ball or tee can then be lifted without a golfer bending down.

Figure 12:
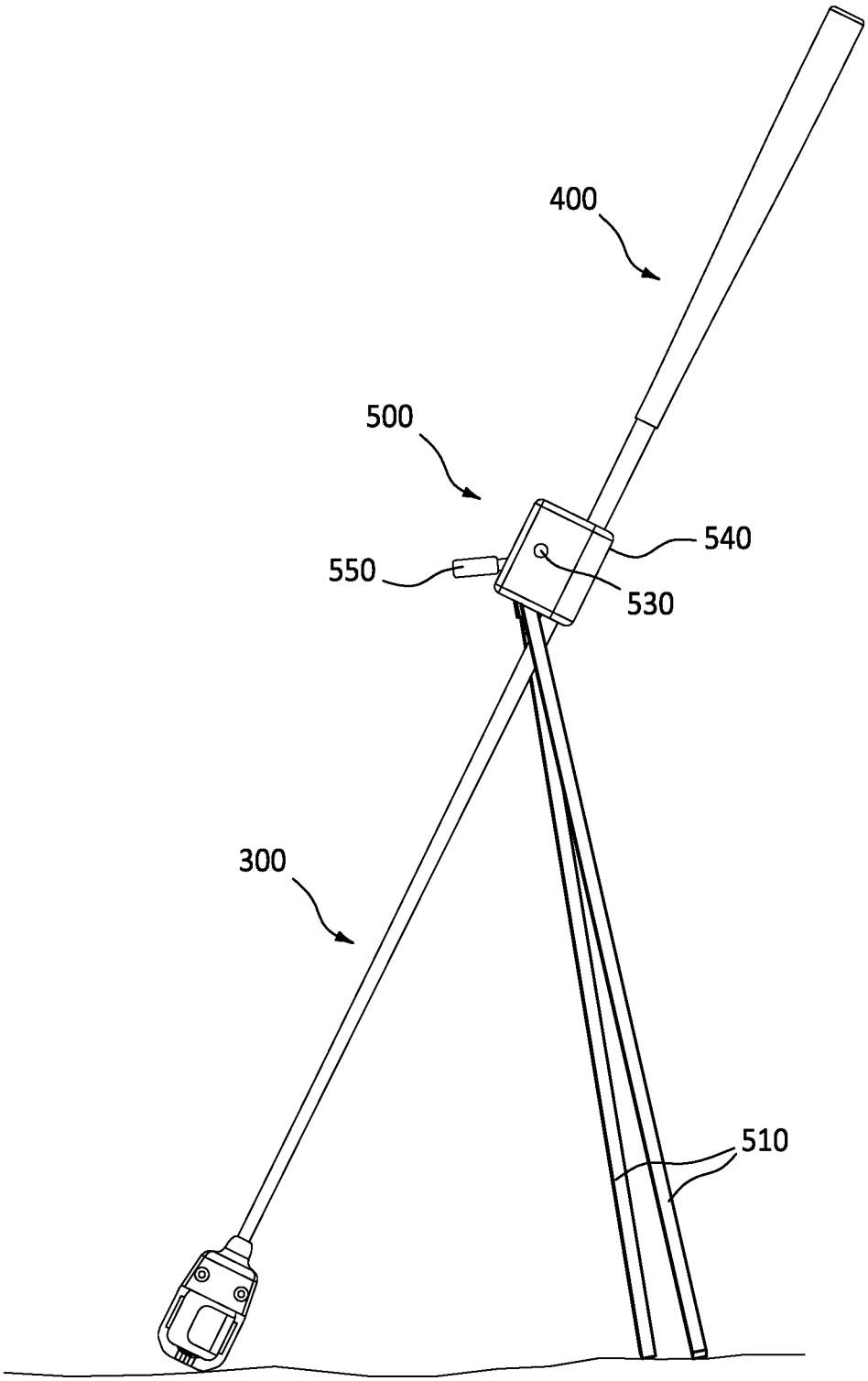
Figure 13:
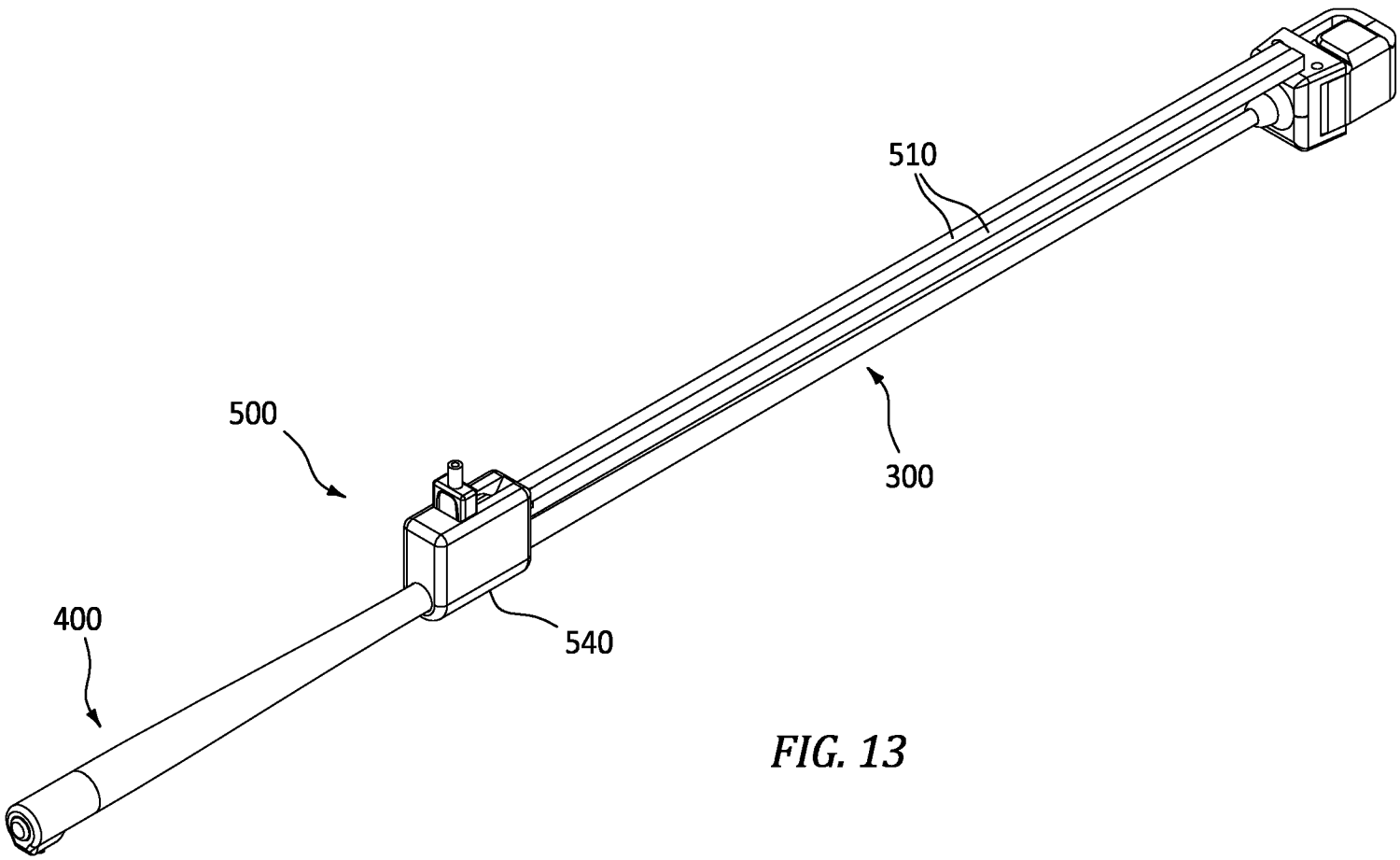

While the device 100 can readily fit within a standard golf bag, a stand 500 is also provided to allow the device 100 to be balanced in upright position, without having to be laid along the ground, as best seen in FIGS. 12 and 13. The stand 500 is not intended to be limited to only the device presented, but any rod-shaped device such as a golf club, fishing pole, or any other device primarily consisting of a rod. The stand 500 works in conjunction with the device 100 to form a tripod. The stand 500 has two additional legs 510 affixed to a slider 520. The slider 520 has a cavity, i.e., an eccentrically-winding channel 521 allowing travel along a predetermined path relative to a stationary retaining pin 530 extending therethrough. The slider 520 also has two edges or camming surfaces, a first leading edge 522 and second angled leading edge 523, both of which are formed to mate with the tubular shaft 300.

The stand 500 is enclosed by a housing 540 permanently attached to the device 100, and the retaining pin 530 holds the slider 520 within the housing 540. The slider 520 also has a lever 550 affixed and stationary relative to the slider 520. FIG. 13 shows the stand legs 510 retracted against the shaft 300 of the teeing device 100, e.g., for carrying and/or inserting in a golf bag.

To extend and mount the legs 510 of the stand, one presses down on the lever 550 which causes the slider 520 to follow the path guided by the retaining pin 530 extending through the cavity 521, in a motion that initially lowers the legs 510, thus moving the first leading edge 522 that is mated with the tubular shaft 300, and then projecting the legs 510 outwardly and away from one another, by engaging the second leading edge 523 mated with the tubular shaft 300, to form a tripod with the teeing device 100 itself (FIG. 12).

Placing the tripod on the ground will also cause upward pressure, stabilizing the device 100. The legs 510 are also shaped to extend around the shaft 300 when engaged. While the drawings depict the stand 500 permanently attached to the device 100, other attachment means, both permanently and semi-permanently, are contemplated.

An advantage provided by this type of stand 500 coupled to the teeing device 100, is moving the pair of legs 510 of the stand away from a user to reliably mount the teeing device 100 upright with swift action and the teeing device 100 itself forming the third leg of a tripod mounting. This makes it easier for a golfer to mount the teeing device upright between use.

Figure 17:
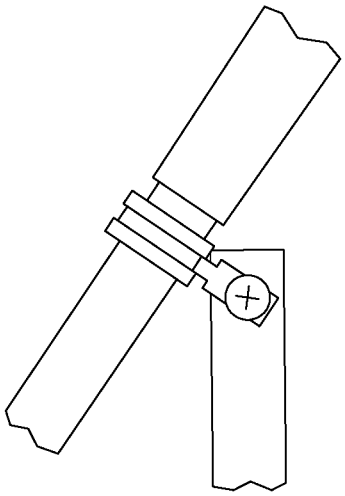
FIG. 17 is an enlarged view of the dotted encircled area in FIG. 16.
Figure 16:
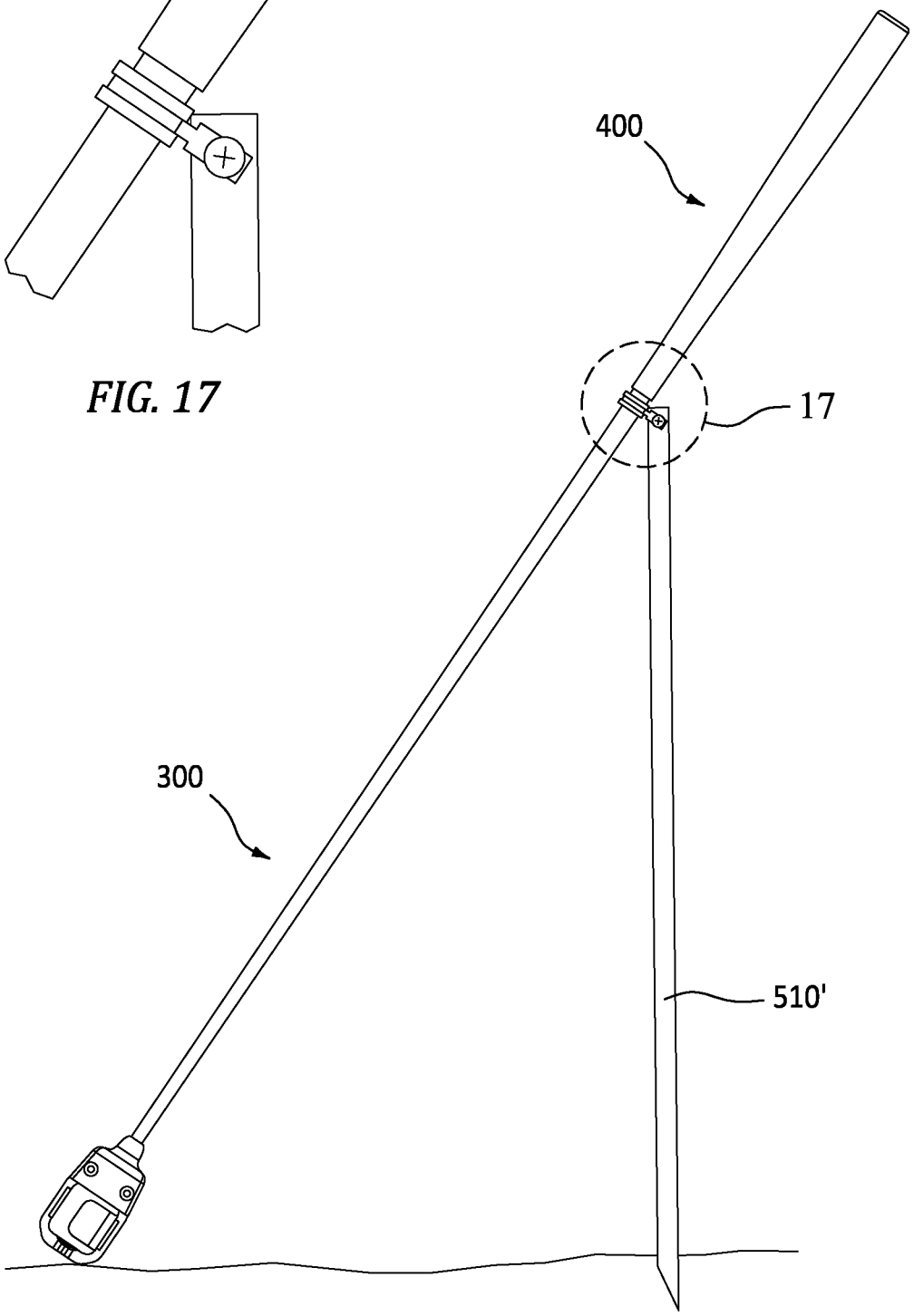

FIGS. 16 and 17 illustrate another type of stand for supporting the golf ball teeing device in upright position, in which the stand has just a single support leg 510'. In this embodiment, a collar encircles the shaft of the golf ball teeing device, and has a laterally extending clamping projection with a bore therethrough. This bore extends substantially perpendicularly to the opening through the collar and encircling the shaft.

The support leg in this embodiment has an opening at the top end to receive a pivot pin or screw which also extends through the bore of the clamping projection. This pivot pin or screw is tightened to secure the collar around the shaft of the teeing device while, at the same time, allowing the stand leg to be pivoted toward or away from the teeing shaft. Therefore, the stand leg 510' is pivotal away from the golf ball teeing device shaft to support the golf ball teeing device at an angle in upright position as shown in FIG. 16 (and is provided with a sharp bottom end to effectively pierce the ground).

The preceding description of the present invention is merely exemplary and not intended to limit the scope thereof in any way.

What is claimed is:

1. A golf ball teeing device comprising a seat for a golf ball, a pair of jaws arranged on either side of the golf ball seat and forming an opening for a tee for the golf ball at mating ends thereof, means for biasing the jaws together, a rod arranged to open the jaws against the biasing means and release the golf ball and tee from therebetween, a tubular shaft on which the jaws are pivotally mounted, and through which the rod movably extends along the shaft, the rod being configured, when pushed, to contact the jaws and pivotally open them against said biasing means, a meshing gear situated at an end of the rod, a pair of meshing gears each pivotally arranged on a respective jaw and interlocking with the meshing gear at the end of the rod, such that pushing the rod against the action of the biasing means pivots the jaws outwardly from one another, and a stand pivotally mounted on the tubular shaft and comprising a pair of legs arranged to pivot downwardly and outwardly in parallel to support the device in upright position, a housing at an upper end thereof, and having a through-hole through which the device extends, a stationary pin mounted with said housing, a slider movably mounted within said housing, with said legs pivotally coupled to said slider which comprises an eccentrically-winding channel through which said pin is engaged, a pair of cam surfaces angled with respect to one another and contact the device extending through said through-hole, and a lever extending outwardly therefrom, such that depressing said lever causes said legs to first extend downwardly and then outwardly from one another, as said cam surfaces press against the device, to open the stand in the form of a tripod together with the device.

2. The device of claim 1, additionally comprising an actuating button movably mounted upon a spring extending around an opposite end of the rod from the jaws, said spring constituting said biasing means, such that depressing the button, forces the jaws apart against biasing action of the spring.

3. The device of claim 2, additionally comprising a locking button arranged to seat in a groove on the actuating button and lock the same against triggering opening of the jaws.

4. The device of claim 1, wherein said legs are configured to pivot in a direction away from said lever and therefore away from a user depressing said lever.

5. The device of claim 4, wherein said stand consists of said two legs.

6. The device of claim 1, additionally comprising a collar mounted at an end of the tubular shaft and on which the jaws are pivotally mounted, the collar having a receptacle on a surface thereof for a golf ball.

7. The device of claim 3, additionally comprising a second spring on which said locking button is movably mounted to lock the jaws from triggering against biasing action of the second spring.

8. The device of claim 7, wherein the locking button is arranged to engage and lock the actuating button from triggering, from only the side of the actuating button on which the locking button is mounted.

9. The device of claim 7, wherein the actuating and locking buttons are mounted substantially perpendicular to one another.

10. A stand for mounting a golf ball teeing device in upright position, and comprising a housing at an upper end thereof, and having a through-hole through which the device can extend, a pair of legs arranged to pivot downwardly and outwardly in parallel to support the device in upright position, a stationary pin mounted with said housing, a slider movably mounted within said housing, with said legs pivotally coupled to said slider which comprises an eccentrically-winding channel through which said pin is engaged, a pair of cam surfaces angled with respect to one another and contact the device extending through said through-hole, and a lever extending outwardly therefrom, such that depressing said lever causes said legs to first extend downwardly and then outwardly away from one another, as said cam surfaces press against the device, to open the stand in the form of a tripod together with the device.

11. The device of claim 10, wherein said legs are configured to pivot in a direction away from said lever and therefor away from a user depressing said lever.

* * * * *